US007654977B2

(12) United States Patent
Lowenstein

(10) Patent No.: US 7,654,977 B2
(45) Date of Patent: Feb. 2, 2010

(54) MOUTH ADAPTER

(75) Inventor: Rikke Lowenstein, Frederiksberg (DK)

(73) Assignee: Zimpl ApS, Copenhagen (DK)

( * ) Notice: Subject to any disclaimer, the term of this patent is extended or adjusted under 35 U.S.C. 154(b) by 0 days.

(21) Appl. No.: 11/280,857

(22) Filed: Nov. 15, 2005

(65) Prior Publication Data

US 2006/0178618 A1 Aug. 10, 2006

Related U.S. Application Data

(60) Provisional application No. 60/628,487, filed on Nov. 16, 2004.

(30) Foreign Application Priority Data

Nov. 16, 2004 (DK) ..... 2004 01773

(51) Int. Cl.
*A61J 7/00* (2006.01)

(52) U.S. Cl. ..... 604/77

(58) Field of Classification Search ..... 604/77, 604/264, 222, 19, 48; 606/236, 234
See application file for complete search history.

(56) References Cited

U.S. PATENT DOCUMENTS

| | | | | | |
|---|---|---|---|---|---|
| 2,550,210 | A | * | 4/1951 | Vance, Jr. | 222/320 |
| 2,680,441 | A | * | 6/1954 | Krammer | 604/217 |
| 2,698,015 | A | * | 12/1954 | Brown | 604/82 |
| 2,786,769 | A | * | 3/1957 | Greenspan | 426/117 |
| 3,749,084 | A | * | 7/1973 | Cucchiara | 600/575 |
| 3,872,864 | A | * | 3/1975 | Allen, Jr. | 604/89 |
| 4,127,126 | A | * | 11/1978 | Schunk | 604/77 |
| 5,029,701 | A | * | 7/1991 | Roth et al. | 206/232 |
| 5,244,122 | A | | 9/1993 | Botts | |
| 5,383,906 | A | * | 1/1995 | Burchett et al. | 606/236 |
| 5,431,680 | A | * | 7/1995 | Jones | 606/236 |
| 5,657,718 | A | * | 8/1997 | Drozdowski | 119/230 |
| 5,824,012 | A | * | 10/1998 | Burchett et al. | 606/236 |
| 5,848,588 | A | * | 12/1998 | Foley et al. | 128/200.23 |
| 5,891,165 | A | | 4/1999 | Buckner | |
| 6,110,193 | A | * | 8/2000 | Chen | 606/234 |
| 6,126,679 | A | * | 10/2000 | Botts | 606/236 |
| 6,161,731 | A | * | 12/2000 | Sigg | 222/158 |
| 6,270,519 | B1 | * | 8/2001 | Botts | 606/236 |
| 2002/0055718 | A1 | * | 5/2002 | Hunt | 604/198 |

(Continued)

FOREIGN PATENT DOCUMENTS

| | | |
|---|---|---|
| EP | 1260209 A2 | 11/2002 |

(Continued)

*Primary Examiner*—Kevin C Sirmons
*Assistant Examiner*—Michael J Anderson
(74) *Attorney, Agent, or Firm*—Darby & Darby P.C.

(57) ABSTRACT

Mouth adapter (1) for oral administration of a fluid mixture, comprising a generally elongate body (10) having a proximally disposed handle end (12) and a distally disposed outlet end (11); a lumen (15) provided in said body (10) adapted for receiving a syringe (2), said syringe (2) comprising a tip (24) extending from a distal end wall (23); and an outlet (16) in communication with said lumen (15) provided in said outlet end (11), wherein said outlet end (11) has a rounded, smooth and substantially rigid outer surface (50), the mouth adapter (1) being provided with stop means (40, 41, 42, 43) for preventing said tip (24) from extending from the exterior surface of the outlet end (11).

22 Claims, 8 Drawing Sheets

U.S. PATENT DOCUMENTS

2002/0148852 A1 10/2002 Schultz
2006/0178618 A1* 8/2006 Lowenstein ..... 604/77

FOREIGN PATENT DOCUMENTS

GB 2295076 A 5/1996
GB 2309966 8/1997
GB 2336541 A 10/1999

* cited by examiner

MOUTH ADAPTER

The invention relates to a mouth adapter for oral administration of a fluid mixture comprising a generally elongate body having a proximally disposed handle end and a distally disposed outlet end, a lumen provided in the body, and an outlet provided in the outlet end, the outlet being in communication with the lumen, the outlet end having a rounded and smooth and substantially rigid outer surface, and the lumen being adapted for receiving a syringe, the syringe comprising a tip extending from a distal end wall.

Different types of medicaments or dietary supplements such as vitamins, penicillin products, and fluid vaccines etc. are often administered orally to infants and small kids in the form of a liquid mixture. It is often a problem to administer such liquid compounds to the child because the taste does not agree with the child or because the child is generally unwilling due to the condition of the child, e.g. in the case where the child is sick.

One way to orally administer such a fluid compound is by means of a spoon. In particular when the child is unwilling this is disadvantageous, because the fluid compound easily will slip of the spoon resulting in imprecise dosing of the fluid mixture, e.g. a medicament, to be administered. Therefore, such liquid mixtures are often administered orally by use of a syringe.

Some prior art devices for oral administration such as taught in U.S. Pat. No. 5,244,122, GB-A-2-295-076, and U.S. Pat. No. 2002-148-852 are intended for cheating the child, by concealing the administering device (the syringe) and/or the taste of the fluid mixture, by administering the fluid mixture together with food, milk or something else that the child likes to eat or drink. However, often such fluid mixtures have a very dominating taste, and it is not usually possible to cheat the child this way more than a few times at best. Consequently, these devices have the disadvantage that the child may start to dislike the things that are used in the attempt to conceal the taste of the fluid mixture, which things may be vital for the child's wellbeing. Also attempts have been made to conceal the administering device (syringe) as a pacifier/nap such as in U.S. Pat. No. 5,891,165. This device has the disadvantage that the child will likely be discouraged from using the pacifier, with the consequence that it might become harder to calm the child down when sad or tired, etc.

GB-A-2-336-541 teaches a tubular sheath for placement over a syringe with the purpose of providing decorations on the exterior surface of the sheath in order to distract the infant by an appealing look of the exterior surface of the device. The tubular sheath has a chamber for receiving a syringe, and an outlet formed in the distal end of the sheath. During use the tip of the syringe extend beyond the distal end of the outlet. This device does not try to cheat the child with the risk of turning the child against something that the child liked, but provides an appealing look. However, this sheath has other disadvantages.

The standard syringes used to orally administer fluid medications comprise a barrel having a distal inlet/outlet end and an open proximal end, a piston slideably arranged in the barrel, and a tip provided in the distal end. The tip has an abrupt edge at its most distal end which comes into contact with parts of the mouth. Thus, the tip of the syringe may inflame, hurt or damage the mouth of the infant, child or patient, due to the edge at the most distal part of the tip.

It is an object of the present invention to provide a mouth adapter for oral administration of a fluid mixture, e.g. a medicament, by use of a syringe, which mouth adapter prevents discomfort and injuries to the mouth of the child. It is a further object to provide a mouth adapter that feels comfortable in the mouth of the child or patient, and which is easy to handle and manoeuvre into a correct position in the mouth.

It is a further object to provide a mouth adapter that has an ergonomic shape that provides a good grip. It is also an object of the invention to provide a mouth adapter that can easily facilitate precise dosing of fluid mixture, utilizing a minimum of accessories.

It is a further object of the invention to provide a mouth adapter for use with a syringe preventing any part of a syringe to come into contact with the child/patient/recipient of a fluid mixture to avoid contamination of the syringe.

It is also an object of the invention to provide a mouth adapter for use with a syringe in which no parts of the mouth adapter is in contact with the fluid mixture to be administered. Such fluids may be sticky and hard to remove.

Finally, it is an object to provide an alternative mouth adapter, and to provide a mouth adapter that overcomes the disadvantages of the prior art devices for oral administration of a fluid mixture.

The object of the invention is achieved by a mouth adapter comprising a generally elongate body having a proximally disposed handle end, an intermediary section, and a distally disposed outlet end; a lumen provided in said body adapted for receiving a syringe, the syringe comprising a tip extending from a distal end wall of a barrel of the syringe; and an outlet in communication with the lumen provided in the outlet end, in which the outlet end has a rounded, smooth and substantially rigid outer surface, and where the mouth adapter is provided with stop means for preventing the tip from extending from the exterior surface of the outlet end.

Thereby a mouth adapter that does not inflame, hurt or damage the mouth of the infant, child or patient when inserted into the mouth is obtained.

In an embodiment the stop means are disposed in the distal end of said lumen.

In another embodiment the stop means comprises a protrusion adapted for abutment with the distal end wall of a barrel of the syringe.

In yet another embodiment the stop means comprises a protrusion adapted for abutment with a distal wall of the tip. The protrusion may preferably be ring-shaped.

In yet another embodiment the stop means, comprises a passage connecting the outlet with the lumen, the passage being adapted for Luer-connection to the tip of a syringe.

In yet another embodiment the stop means comprises a surface arranged in connection with said lumen at the handle end of the body, the surface being adapted for abutment with a handle flange at the proximal end of a barrel of the syringe.

In yet another embodiment the intermediate section of said body has a cross sectional area smaller than the cross sectional area of the outlet end. The cross sectional area of said intermediary section is 50-95%, preferably 60-90%, and more preferably 70-85% of the cross sectional area of the outlet end.

In yet another embodiment the intermediary section of said body has a cross sectional area smaller than the cross sectional area of the handle end. The cross sectional area of said intermediary section is 30-90%, preferably 40-80%, and more preferably 50-70% of the cross sectional area of the handle end.

In yet another embodiment a bulge is formed in the outlet end, said bulge being formed entirely on one side of a longitudinal axis of said body.

In yet another embodiment the outlet end has a flat disk shaped form. Thereby a configuration of the mouth adapter is achieved that is particularly advantageous for placement of the outlet under the tongue.

In a preferred embodiment a butt is provided at the handle end of said body. The butt provides excellent handling properties for the person who performs the administering of the fluid mixture.

In yet another embodiment the butt is provided with a cup-shaped indention, whereby the mouth adapter be used in an easy way to facilitate the measurement of the dose to be administered.

Preferably the cup-shaped indention is provided with markings for indicating the volume of the cup-shaped indention.

In an embodiment the butt is provided with means for providing a stable stand for the mouth adapter.

Definitions

In connection with the present invention the following definitions are used:

The term "smooth", used in conjunction with a surface, means that said surface ideally is continuous in the sense of free from irregularities, roughness, or projections. The definition of the term "smooth" includes surfaces composed of one or more surface zones having boundary lines (edges) and/or points between neighboring zones at the periphery of each zone. Preferably, each surface zone is continuous in the mathematical sense that for any sectional plane, which may be placed through the rounded surface zone, the curve defined by the surface and the sectional plane is a continuous curve, i.e. a curve having no points, wherein the differential quotient is undefined.

In the case, wherein the surface comprises two or more surface zones as mentioned above, the angle a between any two neighboring zones is in any point along the edge sufficiently obtuse, e.g. between 145 and 180°, to avoid that the edges cause an anatomically irritating or damaging effect when pushed against and/or over the tissue of the inside of the mouth. The said angle, $\alpha$, is defined herein as follows: For any sectional plane, which may be placed through the two surface zones to form two continuous curves defined by the surface of the surface zone and the sectional plane, wherein the two continuous curves intersect in a point located on the edge, $\alpha$ is the angle between the two tangent lines of the two continuous curves at the intersecting point.

The term "rounded" means outwardly arc-shaped. In the case, wherein the surface comprises two or more surface zones as mentioned above, at least one surface zone is fully or partly outwardly arc-shaped.

In conjunction with these definitions of the terms "rounded" and "smooth" the term "rounded and smooth surface" should be understood as a surface being arched and free of indentions or protrusions of a size and form that may cause an anatomically irritating or damaging effect when pushed against and/or over the tissue of the inside of the mouth.

The term "substantially rigid" means non-compressible by hand.

The term "cross sectional area" means the sectional area of a sectional plane disposed perpendicularly to the longitudinal axis of the lumen of the body.

The invention will be described in detail in the following with reference to the drawings in which FIG. 1 is a perspective view of a mouth adapter according to an embodiment of the invention, FIG. 2 is a side view of a standard type syringe;

The Figures illustrate several embodiments of the present invention. It is understood that other embodiments may be utilized and structural and operational changes may be made without departing from the scope of the present invention.

Figure 1:
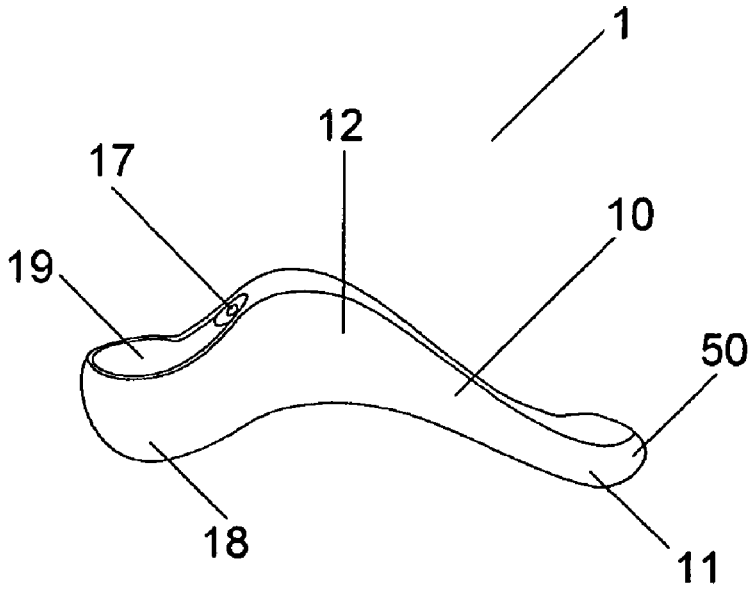

In the following we refer to FIG. 1-15. Referring firstly to FIG. 1, which shows a mouth adapter 1 according to an embodiment of the invention, the mouth adapter 1 comprises a body 10 having a proximally disposed handle end 12, an intermediary section and a distally disposed outlet end 11. The body 10 is provided with an internal lumen 15. The lumen 15 is adapted to receive and hold a standard type medical syringe 2 well known in the art.

Figure 2:
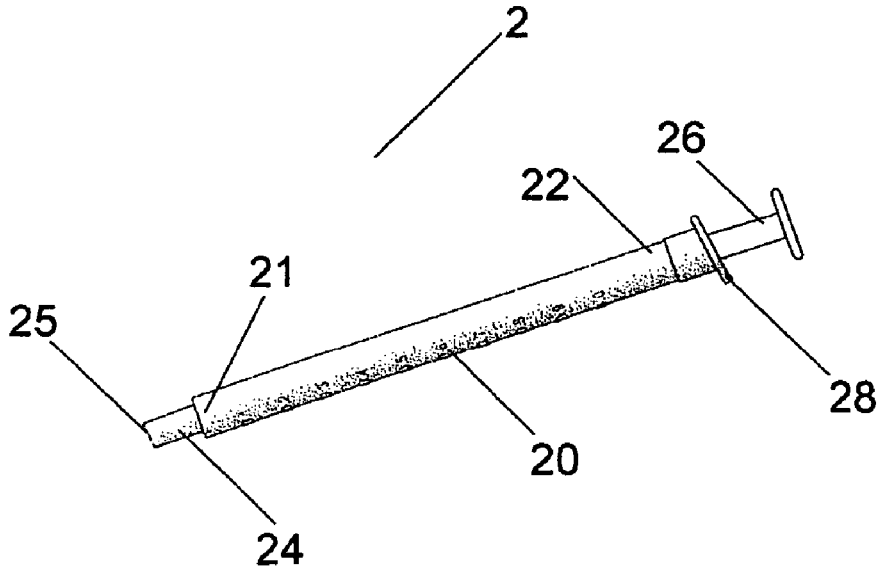

Such a syringe 2 as shown schematically in FIG. 2 comprises a hollow barrel 20 for containing a fluid mixture such as a medicament, the barrel having a distal end 21 and a proximal end 22 a tip 24 disposed at a distally facing end wall 23 of the barrel 20. The tip 24 provides a fluid outlet/inlet from/to the barrel 20. A piston (not shown) connected to a piston rod 26 is slideably arranged within said barrel, such that a fluid content of said barrel 20 can be expelled by pressing the piston towards the distal 21 end of said barrel 20, or such that the barrel 20 can be filled with a fluid mixture by withdrawing the piston towards the proximal 22 end of said barrel 20.

Standard syringes intended for single-use as described above are commonly available in the market in a number of different sizes, dependant on the volume intended to be delivered. Examples of such standard syringes that are commonly used for orally administering medicaments and vitamins to small children are 0.5 ml, 1.0 ml, 2.0 ml and 5.0 ml syringes. These standard syringes vary in length and diameter of the barrel 20. These dimensions may vary also for syringes of the same volume according to the make of the syringe, due to different inner diameters, i.e. wall thicknesses of the barrels. However, the syringes are standardized in that the tip is a uniform luer-type tip, i.e. it is slightly conical, adapted for frictional fit with a standardized needle. Such a tip has a circular cross section, is 8.5 mm long, and has a diameter at its narrow most distal end of 4 mm and a diameter of 4.5 mm at its wider most proximal end.

Figure 3:
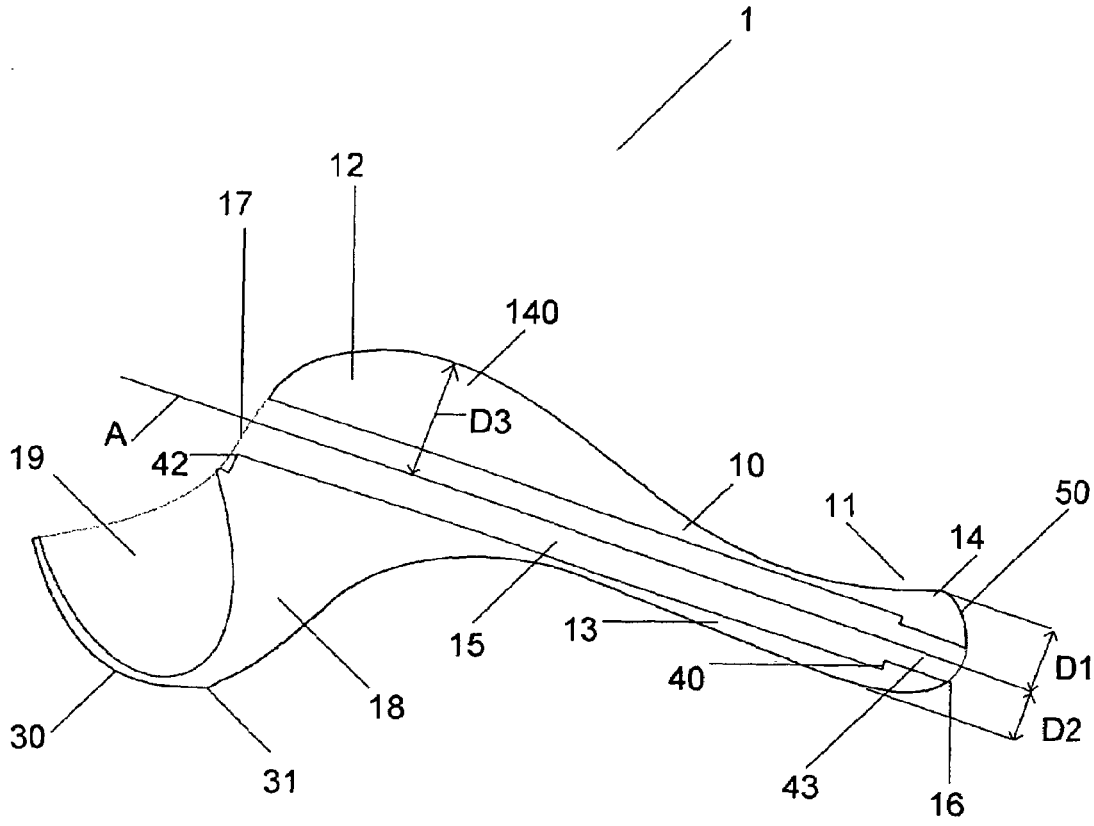
FIG. 3 is a sectional view of the mouth adapter shown in FIG. 1

Now turning to FIG. 3, the lumen 15 of the mouth adapter 1 extends to the proximal end 12 of the body 10. Thus an opening 17 to the lumen 15 is provided in the proximal handle end 12 of the mouth adapter, through which the barrel 20 of the syringe 2 can be inserted into said lumen 15. The lumen 15 is adapted to hold the standard syringe 2. Thus the lumen 15 preferably has a circular cross section, with an inner diameter corresponding to that of the outer diameter of a syringe. However, in other embodiments, the mouth adapter's lumen 15 may have other cross sectional shapes adapted for supporting a syringe 2 in the lumen 15, e.g. a square or triangular shape. These alternative cross sectional shapes may support a conventional cylindrical syringe, but may also be adapted for supporting syringes having corresponding alternative cross-sectional shapes.

The lumen 15 can be dimensioned such that a syringe 2 is held in place by friction between the outer surface of the barrel 20 and the inner surface of lumen 15 in such a way that the friction can be overcome by a person when placing or removing a syringe 2 in/from the lumen 15.

At its distal outlet end 11 the body 10 of the mouth adapter 1 has an outer surface 50 which is rigid and generally smooth and rounded at least at the outlet end 11 as can be seen when viewing the mouth adapter from the distal end thereof. An outlet 16 is provided in the outlet end 11, said outlet 16 being in communication with the internal lumen 15. The lumen 15, the outlet 16, and/or the body 10 is manufactured such that a tip 24 of the syringe 2, when inserted into the mouth adapter 1, is prevented from extending beyond or outside the smooth and rounded outer surface 50 of the outlet end 11 of the mouth adapter 1. Thus it is ensured that the abrupt edge formed at the distal end of tip 24 is prevented from poking, scratching or damaging the inside of the mouth of the child when the distal outlet end 11 of the mouth adapter 1 is inserted into the mouth for delivering a dose of fluid mixture.

The lumen 15 and outlet 16 are preferably formed such that the tip 24 of the syringe 2 inserted into the lumen 15 is close to or directly at the outlet 16. Thus, it is ensured that the outlet from the tip 24 of the syringe can be brought as close as possible to the place in the mouth of the child/patient where the fluid mixture is intended to be delivered to ensure that the fluid mixture is swallowed such to that the correct dose can be delivered. Also, it is thereby prevented to have a channel between the outlet of the tip 24 of the syringe 2 and the outlet 16 of the mouth adapter, which channel would constitute a dead space that would make dosing more difficult, cause a waste of the fluid mixture and be difficult to clean.

To prevent the tip of an inserted syringe 2 from extending beyond the smooth and rounded outer surface of the outlet end 11 of the mouth adapter 1 the mouth adapter 1 comprises stop means 40, 41, 42, 43 for abutment with cooperating parts of a syringe 2 when inserted into the lumen 15 of the mouth adapter 1.

Such stop means may comprise a first protrusion 40 arranged in the distal end of the lumen 15 of the mouth adapter 1, adapted for abutment with the distal surface of a distal end wall 23 of the barrel 20 of the syringe 2, the first protrusion 40 being arranged at a distance from the outlet 16 adapted to the length of the tip 24 of the syringe 2. In the embodiment shown in FIG. 3 the first protrusion is ring-shaped and forms an end surface of the lumen 15 at an entrance to a passage 43 adapted for receiving the tip 24 of the syringe 1.

Figure 4:
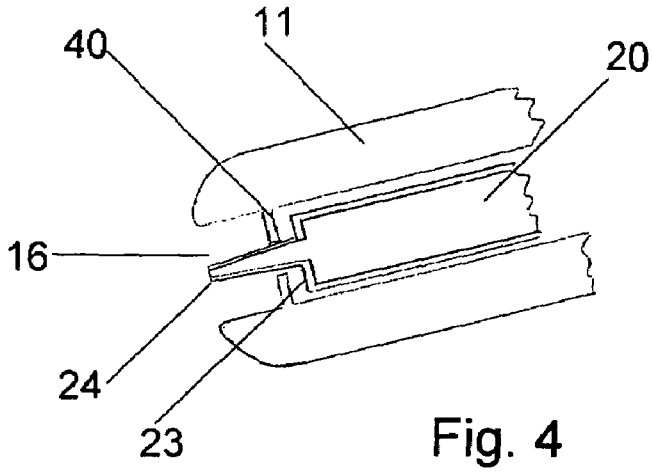
FIG. 4 is a schematic, sectional and partial view of a distal outlet end of a mouth adapter according to a another embodiment.

In another embodiment and as illustrated in FIG. 4 the lumen 15 may extend all the way to the outlet 16, the first protrusion 40 being provided as a ring-shaped flange or as one or more taps formed on the inside surface of the lumen 15.

Figure 5:
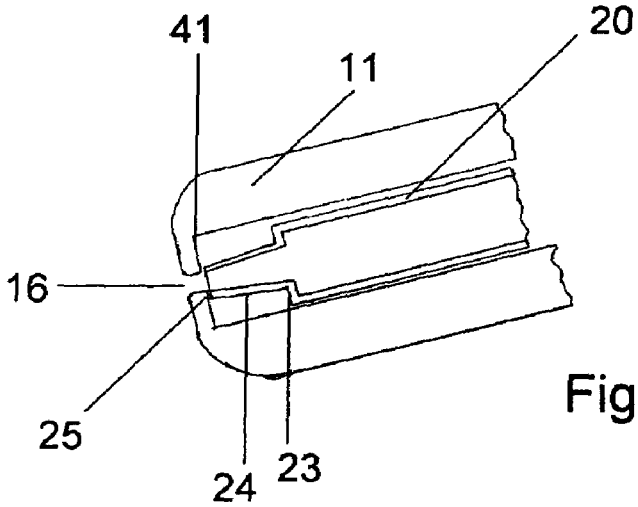
FIG. 5 is a schematic, sectional and partial view of a distal outlet end of a mouth adapter according to a yet another embodiment.
Figure 6:
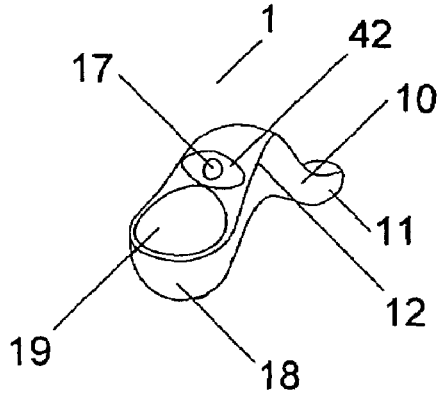
FIG. 6 is a perspective view showing the proximal end of a mouth adapter as shown in FIG. 1.
Figure 7:
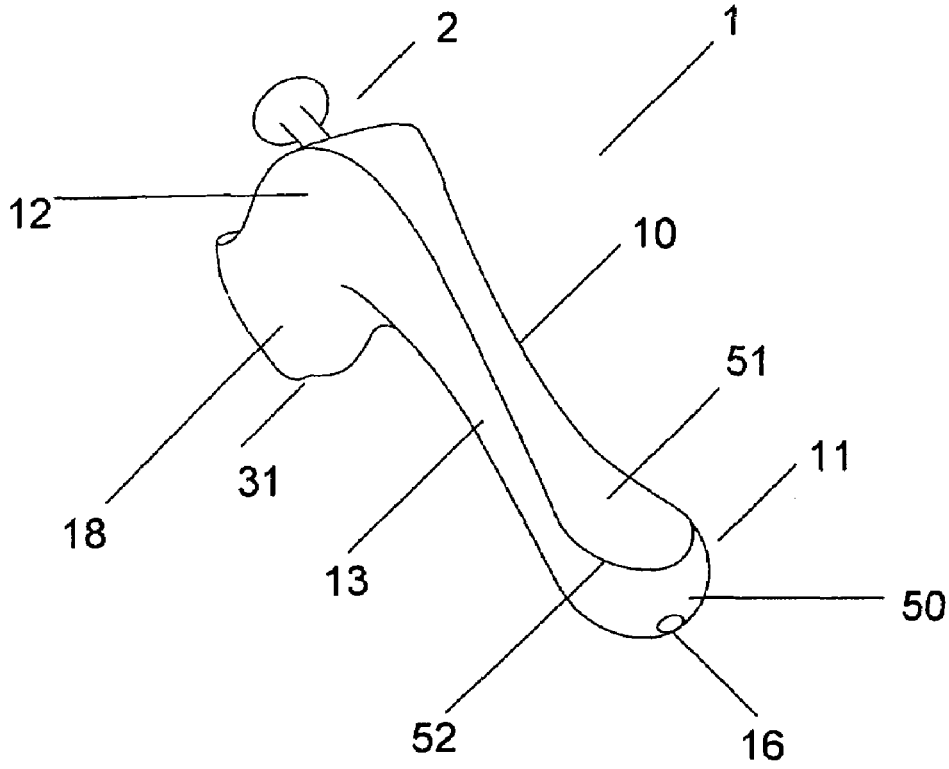
FIG. 7 is a perspective view showing the outlet end of a mouth adapter according as shown in FIG. 1.

Alternatively, stop means may be provided as a second protrusion 41 adapted for abutment with a face facing surface 25 of the tip 24 of the syringe 2, as illustrated in FIG. 5. The second protrusion may be formed as a ring-shaped flange constituting a distal end wall of the lumen 15, or it may be formed as one or more taps arranged in the most distal part of the lumen 15.

Alternatively, both first and second protrusions (40, 41) may be applied.

In general the length of the lumen 15 is dimensioned such that the entire or at least part of the barrel 20 of the syringe 2 is enclosed in the lumen 15. Thus, the proximal end 22 of the barrel 20 of the syringe 2 may extend in the proximal direction from the handle end 12 of the mouth adapter.

In an alternative embodiment, stop means may be provided at the proximal handle end 12 of the lumen 15, as a surface 42 adapted for abutment with the handle flange 28 at the proximal end 22 of the syringe 2, by adjusting the length of lumen 15 to the total length of the barrel 20 and the tip 24 of the syringe 2.

The surface 42 adapted for abutment with the handle flange 28 may be provided as a partial indention in the proximally facing surface of the handle end 12.

The outer diameter of the barrel 20 of the syringe 2 may vary with the volume of the syringe 2, but also with syringes having the same volume the diameter may vary due to varying lengths and due to varying material thicknesses of the barrels according to the make (different manufactures). For example the barrel 20 of a 1.0 ml Omnifix® produced by Braun® has a diameter of approximately 6.5 mm and a length of ca. 74.5 mm, and the barrel of a 1.0 ml syringe by ONCE® has a diameter of approximately 7.0 mm and a length of ca. 78.0 mm. A 2.0 ml syringe by ONCE® has a diameter of ca. 10.0 mm and a length of ca. 50.0 mm.

In a further embodiment the stop means may be provided by a passage 43 formed between the lumen 15 and the outlet 16, the passage 43 being adapted for frictional engagement with the tip 24 of the syringe. The length of the passage is adapted to at least partly enclose tip 24. Preferably the passage is adapted to cooperate with the luer-type tip of a standard type syringe 2, having the dimensions described above, the dimensions of the passage being complimentary to the dimensions of the tip 24.

The passage 43 may be formed such that it will not only provide the stop for a syringe placed in the mouth adapter 1 in order to prevent the tip 24 from extending beyond the exterior surface of the outlet end 11, but also hold the syringe 2 in place in the mouth adapter. Thus, the mouth adapter 1 may be adapted to cooperate with and to hold a number of different kinds of syringes of varying diameters and lengths. Since the syringe is secured in the mouth adapter by the tip 24, the inner diameter of the lumen 15 may be adapted to the outer diameter of the largest desired syringe 2. Thus syringes 2 having a smaller diameter are not held in the mouth adapter 1 by frictional engagement with the lumen 15 but only by frictional engagement of the tip 24 and the passage 43.

For example, a mouth adapter may be adapted for 1.0 and 2.0 ml syringes corresponding to the above mentioned dimensions by having a lumen 15 inner diameter of at least 10.0 mm and a lumen 15 length of a maximum of 50.0 mm.

To provide a good grip for the mouth of the child/patient of the outlet end 11, as well as a good hand grip at the handle end 12 of the mouth adapter 1, which will aid the user, i.e. the person administering the fluid mixture to the child/patient, the body 10 of the mouth adapter 1 is preferably narrower at least on an intermediary section 13 of the body 10 as compared with the outlet end 11, and the handle end 12, i.e. the body 10 has a flask-like shape with a narrow neck.

The cross sectional area of the intermediary section 13 is at its narrowest point 50-95%, preferably 60-90%, and more preferably 70-85% of the largest cross sectional area of the outlet end 11. This shape allows the child/patient to close his/her lips around the outlet end 11, and to rest the lips on the narrower intermediary section 13. Thus, an ergonomically advantageous outlet end 11 of the mouth adapter is obtained that corresponds to the shape of the mouth of the child/patient. The shape of the outlet end 11 thus resembles that of a nap and can possibly aid the placement of the outlet end 11 in the mouth because the child patient will be naturally inclined to suck in the outlet end 11 of the mouth adapter 1.

Additionally or alternatively, the cross sectional area of the intermediary section 13 is at its narrowest point 30-90%, preferably 40-80%, and more preferably 50-70% of the largest cross sectional area of the handle end 12. The handle end 12 preferably has a cross sectional area at its widest point larger than the cross sectional area of the outlet end 11 at its widest point. Thus, the handle end provides a good grip for the hand of the person administering the fluid mixture to the child/patient, because the surface between the wider handle end 12 and the narrower intermediate section will form an ergonomically natural rest for the index and long/middle fingers, while leaving the thumb free for moving the piston of the syringe 2.

This ergonomic form will provide a more accurate dosing when administering the fluid mixture to a child, because the excellent mouth grip for the child at the outlet end 11, and the excellent hand grip of the handle end 12 allows the mouth adapter 1 to be easily maneuvered in the mouth of the child, such that the correct position in the mouth for injecting the fluid mixture can be obtained.

The outlet end comprises approximately a distally disposed 10-30% of the length of the body 10, and the handle end 12 comprises approximately a distally disposed 40-60% of the length of the body 10. The intermediary section comprises approximately 20-40% of the length of the body.

Turning now to FIG. 3 again, a bulge 14 may be formed at the outlet end 11 of the mouth adapter 1. The bulge 14 is formed entirely on one side of a plane through the mouth adapter, said plane defining an upper section and a lower section of the mouth adapter. The plane is coinciding with the general longitudinal axis A of the body 10 of the mouth adapter 1, which axis A is generally coinciding with the axis of a lumen 15, and thus, with the axis of the barrel 20 of a cylindrical syringe 2, when inserted into the mouth adapter 1. In FIG. 3, said plane is formed perpendicular to the plane of the paper. Thus, at the outlet end 11 an asymmetric cross-section occurs due to the bulge 14. During insertion of the outlet 11 end of the mouth adapter 1 into the mouth of a child/patient, the bulge is intended to face upwards towards the palate of the mouth. Thus, the bulge 14 defines an upper side/section of the mouth adapter 1.

The shape of the body part 10 of the mouth adapter 1 is preferably formed such that the passage from the intermediate section 13 to the outlet end 11 with the bulge 14 has a concave arc on the upper side/section defined by the bulge 14. The passage from the intermediate section 13 to the outlet end 11 preferably has a slightly convex arc on the lower side/section.

The bulge 14, thus, improves the ergonomic fit of the outlet end 11 of the mouth adapter 1 with the mouth of the child/user. Due to the bulge 14, the form of the outlet end 11 of the mouth adapter further resembles the shape of a nap.

Further the bulge 14 aids the user in positioning the mouth adapter correctly in the mouth of the child/patient. The bulge extends partially sideways or forms a kink on the generally elongate body 10 with respect to the general longitudinal axis, A, of the mouth adaptor 1. Thus the mouth adapter has a shape that will allow the placement of the body 10 such as to generally avoid contact between the body 10 and the upper edge of teeth of the lower jaw of the child/patient, i.e. the mouth adapter 1 can be placed in the mouth of the child/patient, such that the longitudinal axis, A, of the body 10 forms an angle with the plane of the teeth, and still have an outlet end that is pleasant to hold in the mouth, because this outlet end 11 may thus extend essentially perpendicularly to the plane of the teeth.

The dimensions of the bulge 14 of course depends on the size of the mouth adapter 1, which again is dependant on the size of the syringe 2 to be used with the mouth adapter. However, preferably, the cross sectional distance D1 from the longitudinal axis A to the extremity of the bulge 14 is 110-150%, and more preferably 115-135% of the cross sectional distance D2 from the longitudinal axis A to the extremity of the convex lower side of the outlet end 11.

The mouth adapter 1 may also be provided with a second bulge 114 at the proximally disposed handle end 12, such that the handle end 12 may also have an asymmetric cross-section. The bulge is preferably formed at the same side/section, i.e. the upper side/section, as the bulge 14 at the outlet end. This second bulge will improve the grip, especially for the index finger, when handling the mouth adapter 1. Preferably, the cross sectional distance D3 from the longitudinal axis A to the extremity of the second bulge is 200-300% and more preferably 230-260% of the cross sectional distance D2 from the longitudinal axis A to the extremity of the convex lower side of the outlet end 11.

As shown in FIGS. 1 and 6-8 a substantially flattened surface 51 may be formed on the outer surface of the body 10 of the mouth adapter 1, said flattened surface 51 being formed entirely on the upper side/section as defined above. In the case where the mouth adapter 1 also comprises a bulge 14, as described above, the flattened surface 51 and the bulge are formed on the same side of said plane, i.e. the bulge 14 and the flattened surface are formed in said upper side/section of the mouth adapter 1. In the case where no bulge 14 is formed on the mouth adapter 1 the flattened surface 51 thus defines an upper side of the mouth adapter 1.

The flattened surface 51 provides for an improved grip of the handle end 12 of the mouth adapter by forming an improved resting surface for the tip of index finger of the person administering the fluid mixture to the child/patient. Also the flattened surface 51 at the outlet end 11 may provide for easier guidance within the mouth of a child/patient during use, e.g. under the tongue.

Thus a boundary 52 (see e.g. FIG. 7) between the flattened surface 51 and the substantially smooth and rounded surface 50 at the outlet end 11 may be present. However, the angle between these surfaces is preferably very obtuse, such that the two surfaces 50, 51 can be considered equivalent to the surface zones as defined above, and such that the boundary area can be considered round and smooth. Thus even a distinct boundary line 52 does not cause any problem with respect to inflaming, hurting or damaging parts of the mouth.

Figure 8:
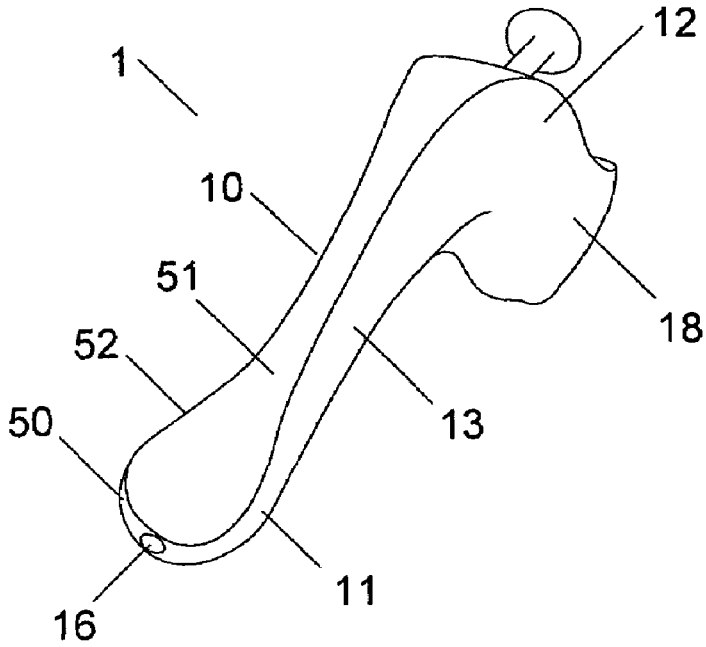
FIG. 8 is a perspective view showing a mouth adapter according to yet another embodiment of the invention holding a syringe.

In a particular embodiment of the invention cf. FIG. 8 the outlet end 11 of the mouth adapter 1 may have a flat disk-shaped head. This is especially advantageous if the fluid mixture is intended for administration under the tongue, i.e.

sublingual administration, because the outlet end 11 can be easily guided to fit under the tongue.

The mouth adapter 1 may in all of the above embodiments advantageously be provided with a butt 18 formed as a downwards extension at the handle end 12. The proximal part of the butt 18 thus forms a proximally facing surface for abutment with the surface of the palm of the hand of the user that is disposed between the thumb and the index finger. The distal part of the butt 18 forms a distally facing surface that the long/middle finger can close around. Thus the butt 18 provides for an excellent grip of the mouth adapter 1 and improves the handling thereof.

Preferably, a trough or cup shaped indention 19 is formed in the butt 18. Thus, a fluid mixture to be administered can be poured into the cup shaped indention 19. Then the correct volume of fluid mixture can be sucked into the syringe and a possible surplus of fluid mixture may be poured back into a container and reused later. Then the syringe 2 is placed in the lumen 15 and the outlet end 11 of the mouth adapter 1 is inserted into the mouth of the child/infant/patient, and when the outlet is correctly placed in the mouth the fluid mixture is administered by pressing the piston rod of the syringe. In the case where a cup shaped indention 19 is not present the same procedure is used, however, the filling of the syringe 2 may take place using a separate vessel.

The cup shaped indention 19 may advantageously be provided with markings indicating volume of the cup shaped indention 19, the cup shaped indention 19 thereby functioning as a measuring cup.

Figure 9:
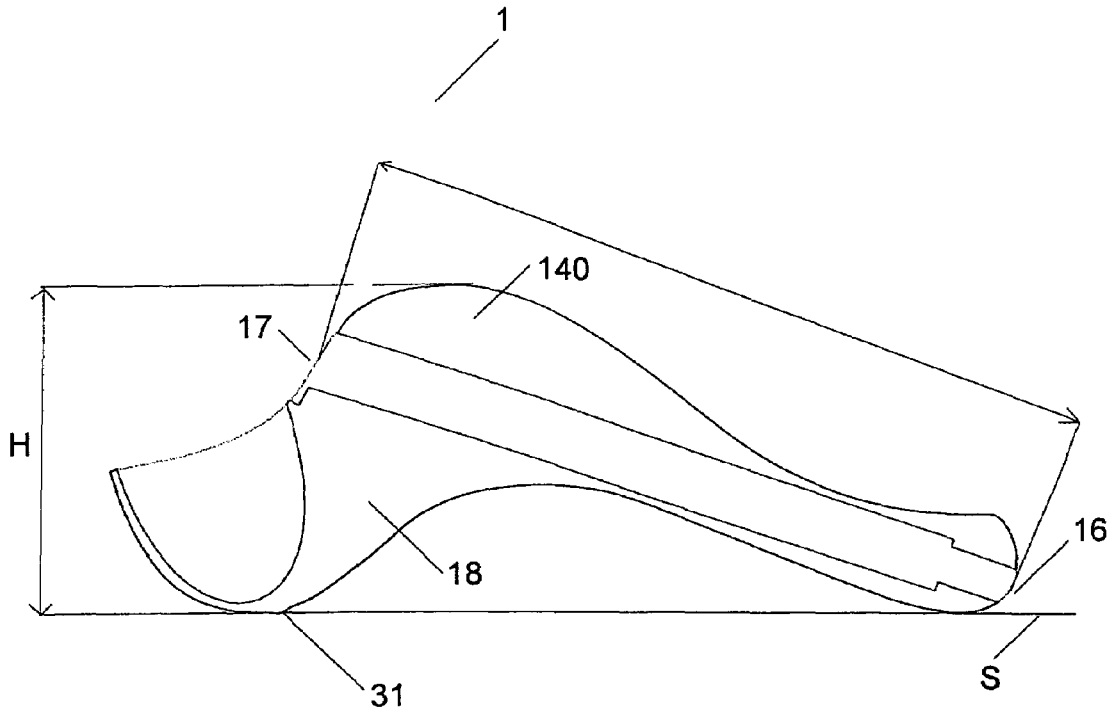
FIG. 9 is the mouth adapter shown in FIG. 3 indicating outer dimensions.

The bottom part 30 of the butt 18 is preferably provided with means 31 providing a stable upright stand for the mouth adapter 1, said means 31 e.g. comprising a flattened surface, or taps. This is illustrated in FIG. 9 in which the mouth adapter 1 also shown in FIG. 3 is shown standing on a flat surface, S.

Figure 10:
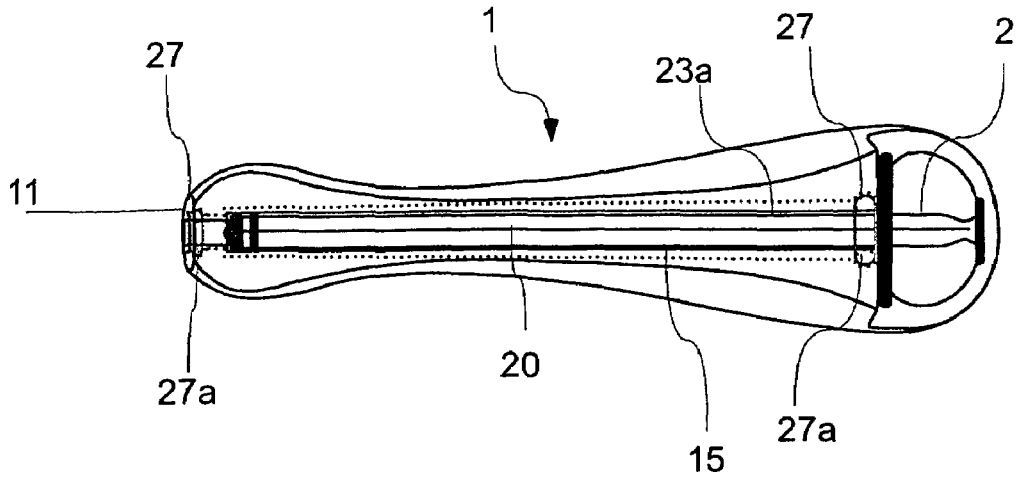
FIG. 10 is a schematic, sectional top view of a preferred embodiment of a mouth adapter.
Figure 11:
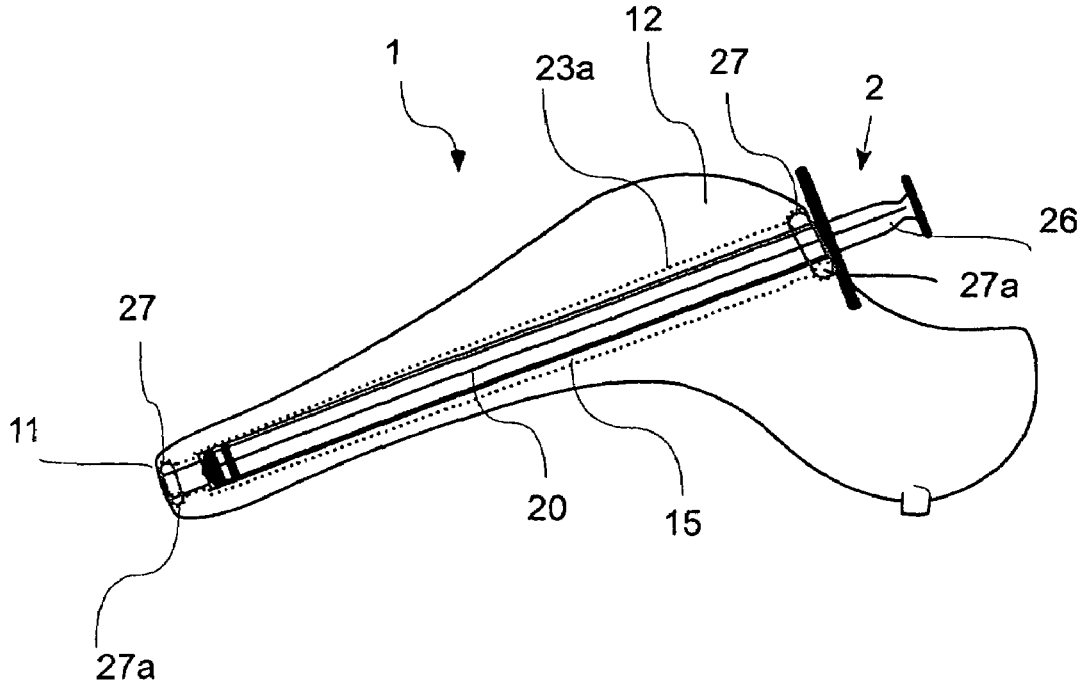
FIG. 11 is a schematic, sectional view of the mouth adapter shown in FIG. 10.

Turning now to FIGS. 10 and 11 a sectional view of a mouth adapter 1 according to an embodiment of the invention is shown. The mouth adapter 1 according to this embodiment of the invention is configured with a securing means in the form of at least one resilient ring-shaped member indicated by reference number 27 arranged inside the lumen 15, and adapted for abutment with an outer wall 23*a* of the barrel 20 of the syringe 2 to thereby secure the syringe 2 in the lumen 15. Preferably the ring-shaped member 27 is configured within a recess 27*a* extending along the periphery of the inner wall 15*a* of the circular lumen 15 at a location in proximity of the opening 17 at the proximal handle end 12 of the mouth adapter 1. A ring-shaped member 27 may in addition be configured at the distally disposed outlet end 11.

Figure 12:
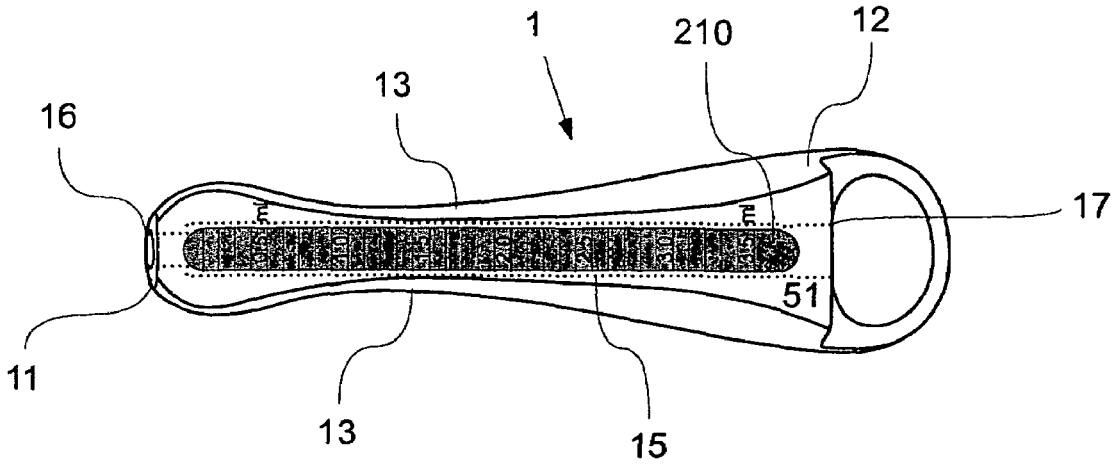
FIG. 12 is a schematic, sectional top view of yet a preferred embodiment of a mouth adapter.
Figure 13:
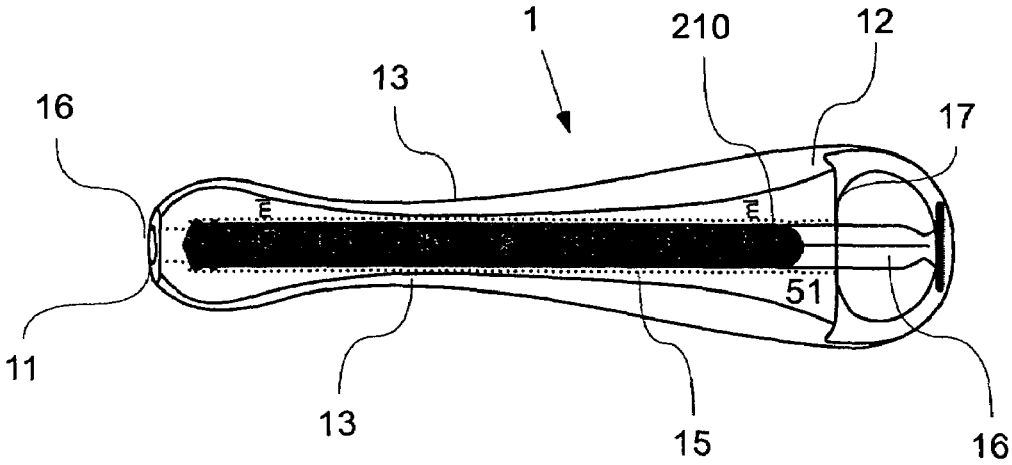
FIG. 13 is a schematic, sectional top view of yet a preferred embodiment of a mouth adapter.
Figure 14:
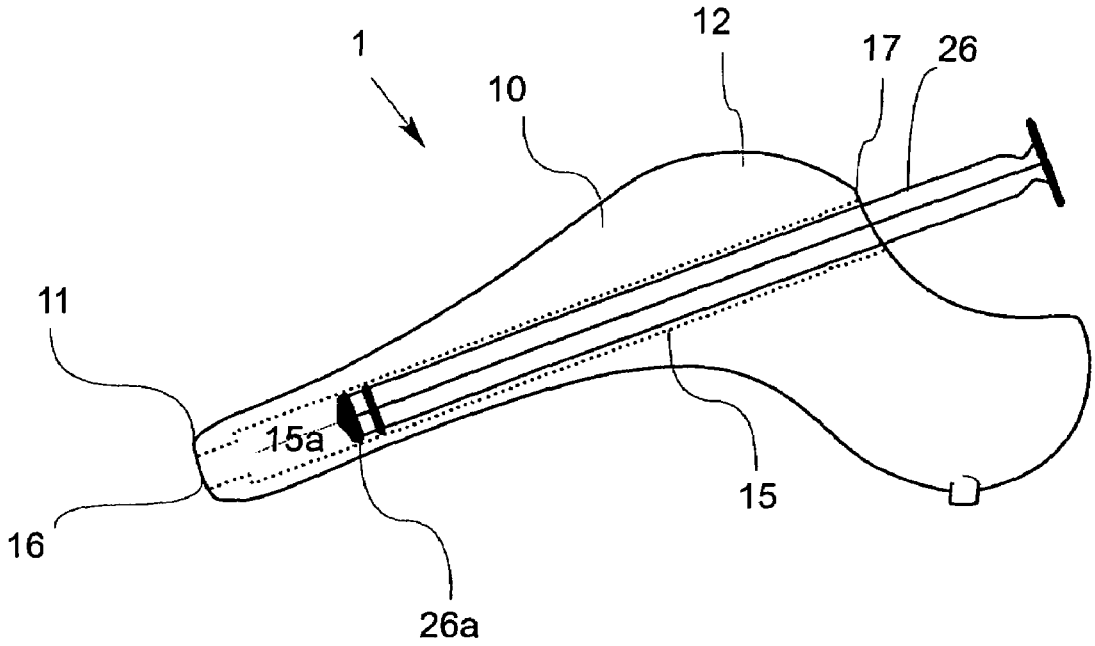
FIG. 14 is a schematic, sectional view of the mouth adapter shown in FIG. 13.
Figure 15:
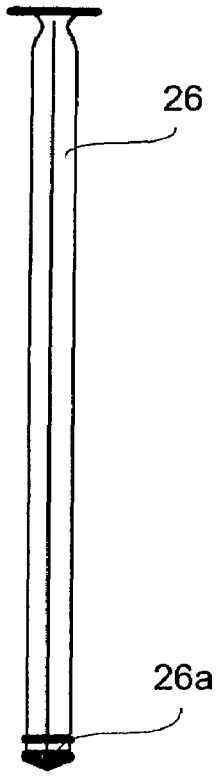
FIG. 15 is a schematic view of the piston rod shown in FIG. 14.

Referring now to FIG. 12 to 14, which show a mouth adapter 1 according to yet a preferred embodiment of the invention, the mouth adapter 1 comprises a body 10 having a proximally disposed handle end 12, an intermediary section 13 and a distally disposed outlet end 11. The body 10 is provided with an internal circular lumen 15(151), having an inner surface/cylindrical inner wall 15*a* and an inner diameter. In FIG. 15 a piston 26*a* connected to a piston rod 26 which may preferably be used in cooperation with the mouth adapter 1 according to this preferred embodiment is shown.

The lumen 15 of the mouth adapter 1 extends to the proximal handle end 12 of the body 10. Thus an opening 17 to the circular lumen 15 is provided in the proximal handle end 12 of the mouth adapter 1, through which a piston 26*a* connected to a piston rod 26 for the operation of the piston 26 can be inserted into said circular lumen 15. Thus the circular lumen 15 preferably has a circular cross section, with an inner diameter corresponding to that of the piston 26*a* being slidable arranged within said circular lumen 15. The inner surface/cylindrical inner wall 15*a* of the circular lumen 15 is preferably smooth and configured in such a way that the friction between inner surface 23*a* and piston 211 is overcome by a person when displacing (operating) the piston 26*a* within the circular lumen 15.

At its distal outlet end 11 the body 10 of the mouth adapter 1 has an outer surface 50 which is rigid and generally smooth and rounded at least at the outlet end 11 as when viewing the mouth adapter from the distal end thereof.

An outlet 16 is provided in the outlet end 11, said outlet 16 being in communication with the internal circular lumen 15. Thus it is ensured that when inserted into the mouth of a person/child for delivering a dose of fluid mixture, poking, scratching or damaging the inside of the mouth of the child when the distal outlet end 11 of the mouth adapter 1 is prevented.

As shown in FIGS. 12 and 13 a transparent panel/window 210 extending along the longitudinal axis (A) of said body 10 is provided in the upper side/section on the flattened surface 51 of the mouth adapter 1. The transparent panel/window 210 is preferably provided with a calibrated scale marking indicating the volume of the circular lumen and may be of any size corresponding to the volume of the circular lumen 15.

The flattened surface 51 moreover provides for an improved grip of the handle end 12 of the mouth adapter by forming an improved resting surface for the tip of index finger of the person administering the fluid mixture to the child/patient. Also the flattened surface 51 at the outlet end 11 may provide for easier guidance within the mouth of a child/patient during use, e.g. under the tongue.

A mouth adapter 1 according to a preferred embodiment comprises: a generally elongate body 10 having a proximally disposed handle end 12, an intermediary section 13, and a distally disposed outlet end 11; a circular lumen 15(151) provided in said body 10, said circular lumen 15 having a cylindrical inner wall 15*a* adapted for cooperating with a piston 26*a*, slidably arranged within said circular lumen 15, said piston 26*a* being connected to a piston rod 26 arranged for the operation of the piston 26*a*, and where an outlet 16 in communication with said circular lumen 15 is provided in said outlet end 11, wherein, said outlet end 11 has a rounded, smooth and substantially rigid outer surface 50.

Mouth adapter according to the above statement, wherein a transparent panel 210 extending along the longitudinal axis (A) of said body 10 is provided in the upper side/section on the flattened surface 51 of the mouth adapter 1.

Mouth adapter according to any of the preceding statements the transparent panel 210 is provided with a calibrated scale marking indicating the volume of the circular lumen 15.

Mouth adapter 1 according to any one of the preceding statements, wherein, the intermediate section 13 of said body 10 has a cross sectional area smaller than the cross sectional area of the outlet end 11.

Mouth adapter 1 according any one of the preceding statements, wherein the cross sectional area of said intermediary section 13 is 50-95%, preferably 60-90%, and more preferably 70-85% of the cross sectional area of the outlet end 11.

Mouth adapter 1 according to any one of the preceding statements, wherein said intermediary section 13 of said body 10 has a cross sectional area smaller than the cross sectional area of the handle end 12.

Mouth adapter 1 according to any one of the preceding statements, wherein the cross sectional area of said intermediary section 13 is 30-90%, preferably 40-80%, and more preferably 50-70% of the cross sectional area of the handle end 12.

Mouth adapter 1 according to any one of the preceding statements, wherein a bulge 14 is formed in the outlet end 11, said bulge being formed entirely on one side of a longitudinal axis (A) of said body 10.

Mouth adapter 1 according to any one of the preceding statements, wherein that the outlet end 11 has a flat disk-shaped form.

Mouth adapter 1 according to any one of the preceding statements, wherein a butt 18 is provided at the handle end 12 of said body 10.

Mouth adapter 1 according to the preceding statement, wherein the butt 18 is provided with a cup-shaped indention 19.

Mouth adapter 1 according to the preceding statement, wherein the cup-shaped indention 19 is provided with markings for indicating the volume of the indention 19.

In a specific embodiment of the mouth adapter, where the lumen 1 is adapted for e.g. a 1,0 ml Omnifix® syringe the overall length, L, of the body 10 from outlet 16 to opening 17 is approximately 85 mm, the internal diameter of the lumen 15 is approximately 6,5 mm, the distance D1 is approximately 7 mm, the distance D2 is approximately 6 mm, and the distance D3 is approximately 15 mm. The height, H, of the mouth adapter 1 from the means 31 for providing a stable upright stand to the extremity of the second bulge 140, when the mouth adapter 1 is left standing on a flat surface, S, is preferably approximately 39 mm.

However, the dimensions of the mouth adapter are preferably adapted to the dimensions of the intended type of syringe to be used together with the mouth adapter. Preferably the overall length, L, of the body 10 from outlet 16 to opening 17 is in the range of 50-100 mm, the internal diameter of the lumen 15 is in the range of 5-12 mm, the distance D1 is in the range of 3-10 mm, the distance D2 is in the range of 1-8 mm, and the distance D3 is in the range of 10-25 mm. The height, H, of the mouth adapter 1 from the means 31 for providing a stable upright stand to the extremity of the second bulge 140, when the mouth adapter 1 having a butt 18 is left standing on a flat surface, S, as indicated in FIG. 9 is preferably in the range of 30-70 mm.

The mouth adapter 1 in any of the above embodiments is preferably formed in a rigid polymer material, such as a plastic. Suitable materials are a polyolefin such as polyethylene, polypropylene or a polybutene. Alternatively, a suitable material could be a polyester such as polycarbonate, an acrylate polymer or copolymer such as polymethylmethacrylate, or a styrene polymer or copolymer. However, the mouth adapter may also be formed in a number of different other materials, e.g. ceramics or metals.

The mouth adapter 1 may be formed as a massive structure (apart from lumen 15, of course). However, to provide a lighter construction, the mouth adapter 1 may also be formed as a generally hollow structure.

The invention claimed is:

1. Mouth adapter comprising:

a unitary one-piece body entirely of a material that is substantially rigid and not compressible by hand having a first elongated section with an outlet at a distal end having an outlet opening, said first section distal end being substantially rigid and not compressible by hand and having a rounded, smooth surface to be directly engaged by the lip of the mouth;

a lumen extending through the length of said first section having an opening at a proximal end adapted for receiving a syringe having a tip extending from a distal end wall of a barrel that is to be inserted from outside of said body into the opening of the lumen at the proximal end of the first section, the distal outlet end of said lumen being axially aligned with said first section outlet end outlet opening, stop means at the proximal end of the first section for preventing the syringe tip from extending from the exterior surface of said first section outlet end, and a second section extending at an angle from said proximal end of said first section of said body to serve as a handle end for said body.

2. Mouth adapter according to claim 1 wherein said stop means are disposed in the distal end of said lumen.

3. Mouth adapter according to claim 2, wherein said stop means comprises a protrusion adapted for abutment with a face surface of the syringe tip.

4. Mouth adapter according to claim 2, wherein said stop means comprises a protrusion adapted for abutment with the distal end wall of the barrel of the syringe.

5. Mouth adapter according to claim 3, wherein said protrusion is ring-shaped.

6. Mouth adapter according to claim 3, wherein said stop means comprises a protrusion adapted for abutment with a face surface of the syringe tip.

7. Mouth adapter according to claim 6, wherein said protrusion is ring-shaped.

8. Mouth adapter according to claim 3, wherein said stop means comprises a passage connecting said outlet end opening with said lumen, said passage being adapted for luer-connection to the tip of the syringe.

9. Mouth adapter according to claim 6 wherein said stop means comprises a surface arranged in connection with said lumen at the handle end of said body, said surface being adapted for abutment with a handle flange at the proximal end of a barrel of the syringe.

10. Mouth adapter according to claim 1 wherein a cross sectional area of said body first section is greater at the first section proximal end than the cross section area of said first section outlet end.

11. Mouth adapter according to claim 10 wherein the cross sectional area of said first section outlet end is 50-95%, preferably 60-90%, and more preferably 70-85% of the cross sectional area of said first section proximal end.

12. Mouth adapter according to claim 10 wherein said first section of said body has a cross sectional area smaller than the cross sectional area of said body handle end.

13. Mouth adapter according to claim 12 wherein the cross sectional area of said first section is 30-90%, preferably 40-80%, and more preferably 50-70% of the cross sectional area of said body handle end.

14. Mouth adapter according to claim 1 wherein said first section outlet end is formed with a bulge entirely on one side of a longitudinal axis of said body.

15. Mouth adapter according to claim 1 wherein said first section outlet end has a flat disk-shaped form.

16. Mouth adapter according to claim 1 wherein the second section is provided with a cup-shaped indention for holding a liquid.

17. Mouth adapter according to claim 16 wherein the cup-shaped indention is provided with markings for indicating the volume of the indention.

18. Mouth adapter according to claim 16 wherein the lower end of the handle is provided with means for providing a stable stand for the mouth adapter.

19. Mouth adapter according to claim 1 further comprising a securing means adapted for securing said syringe within said lumen.

20. Mouth adapter according to claim 19 wherein said securing means comprise at least one resilient ring-shaped member arranged inside the lumen, and adapted for abutment with an outer wall of the barrel of the syringe.

21. Mouth adapter comprising:

a unitary one-piece body having a first elongated section with an outlet at a distal end having an outlet opening, said first section distal end being substantially rigid and not compressible by hand and having a rounded, smooth surface to be directly engaged by the lip of the mouth;

a lumen extending through the length of said first section having an opening at a proximal end adapted for receiving a syringe having a tip extending from a distal end wall of a barrel that is to be inserted from outside of said body into the opening of the lumen at the proximal end of the first section, the distal outlet end of said lumen being axially aligned with said first section outlet end outlet opening, stop means at the proximal end of the first section for preventing the syringe tip from extending from the exterior surface of said first section outlet end, and a second section extending substantially transverse from said proximal end of said first section of said body to serve as a handle end for said body.

22. Mouth adapter comprising:

a unitary one-piece body having a first elongated section with an outlet at a distal end having an outlet opening, said first section distal end being substantially rigid and not compressible by hand and having a rounded, smooth surface to be directly engaged by the lip of the mouth;

a lumen extending through the length of said first section having an opening at a proximal end adapted for receiving a syringe having a tip extending from a distal end wall of a barrel that is to be inserted from outside of said body into the opening of the lumen at the proximal end of the first section, the distal outlet end of said lumen being axially aligned with said first section outlet end outlet opening, stop means at the proximal end of the first section for preventing the syringe tip from extending from the exterior surface of said first section outlet end, and a second section extending at an angle from said proximal end of said first section of said body to serve as a handle end for said body and having a cup-shaped indentation for holding a liquid.

* * * * *